US010054358B2

(12) United States Patent
Park et al.

(10) Patent No.: US 10,054,358 B2
(45) Date of Patent: Aug. 21, 2018

(54) REFRIGERATOR AND METHOD OF OPERATING THE SAME

(71) Applicant: LG Electronics Inc., Seoul (KR)

(72) Inventors: Junsoo Park, Seoul (KR); Jiyeong Ku, Seoul (KR); Jiyoon Lee, Seoul (KR); Jiyoung Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/546,434

(22) PCT Filed: Jan. 26, 2016

(86) PCT No.: PCT/KR2016/000819
§ 371 (c)(1),
(2) Date: Jul. 26, 2017

(87) PCT Pub. No.: WO2016/122189
PCT Pub. Date: Aug. 4, 2016

(65) Prior Publication Data

US 2018/0017313 A1 Jan. 18, 2018

(30) Foreign Application Priority Data

Jan. 26, 2015 (KR) ..... 10-2015-0012232

(51) Int. Cl.
*F25D 23/00* (2006.01)
*F25C 1/00* (2006.01)
*F25D 23/12* (2006.01)

(52) U.S. Cl.
CPC ..... *F25D 23/003* (2013.01); *F25C 1/00* (2013.01); *F25D 23/126* (2013.01); *F25C 2400/14* (2013.01); *F25C 2600/04* (2013.01); *F25C 2700/14* (2013.01); *F25D 2400/30* (2013.01)

(58) Field of Classification Search
CPC ..... F25C 2400/14; F25C 5/10; F25C 2700/14
See application file for complete search history.

(56) References Cited

U.S. PATENT DOCUMENTS 5,425,248 A * 6/1995 Trantina ..... F25C 1/04 62/349
2003/0145608 A1* 8/2003 Billman ..... F25C 1/12 62/74
2012/0036874 A1* 2/2012 Li ..... F25B 31/006 62/89

* cited by examiner

*Primary Examiner* — Cassey D Bauer
(74) *Attorney, Agent, or Firm* — Fish & Richardson P.C.

(57) ABSTRACT

The present invention provides a refrigerator including a compressor for compressing refrigerant, a condenser in which the refrigerant, which has been compressed in the compressor, is condensed, an icemaker, a water supply tube, which supplies water to the icemaker and is in contact with at least one of the compressor and the condenser, an ice-making water supply valve installed in the water supply tube, a temperature sensor installed at the water supply tube, and a controller for controlling the ice-making water supply valve based on a temperature detected by the temperature sensor. Water having a temperature that is raised to a temperature range set in consideration of the Mpemba effect is supplied to the icemaker, thereby enabling rapid ice making.

12 Claims, 5 Drawing Sheets

[Fig. 1]
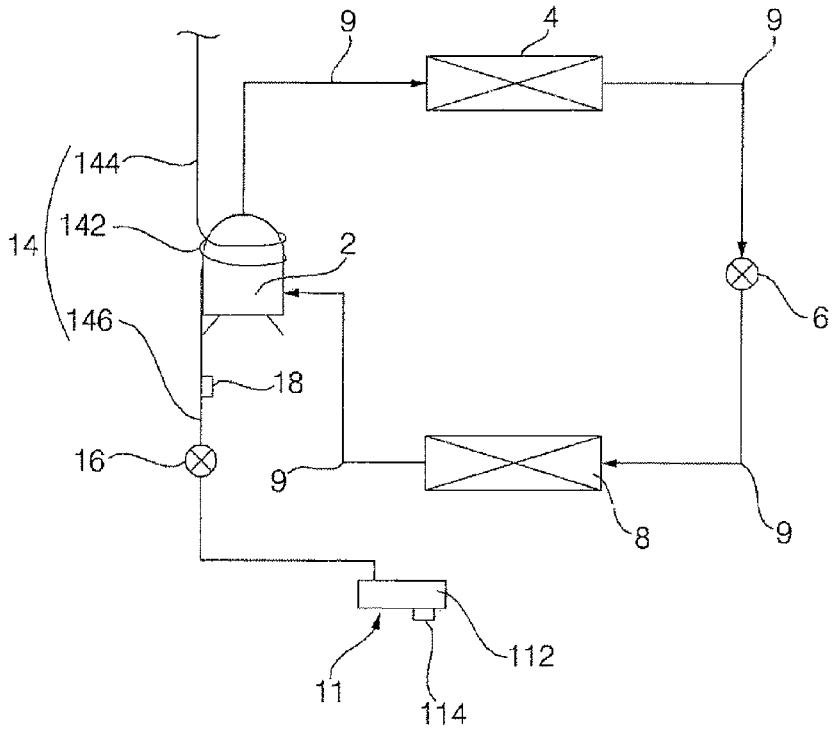

[Fig. 2]
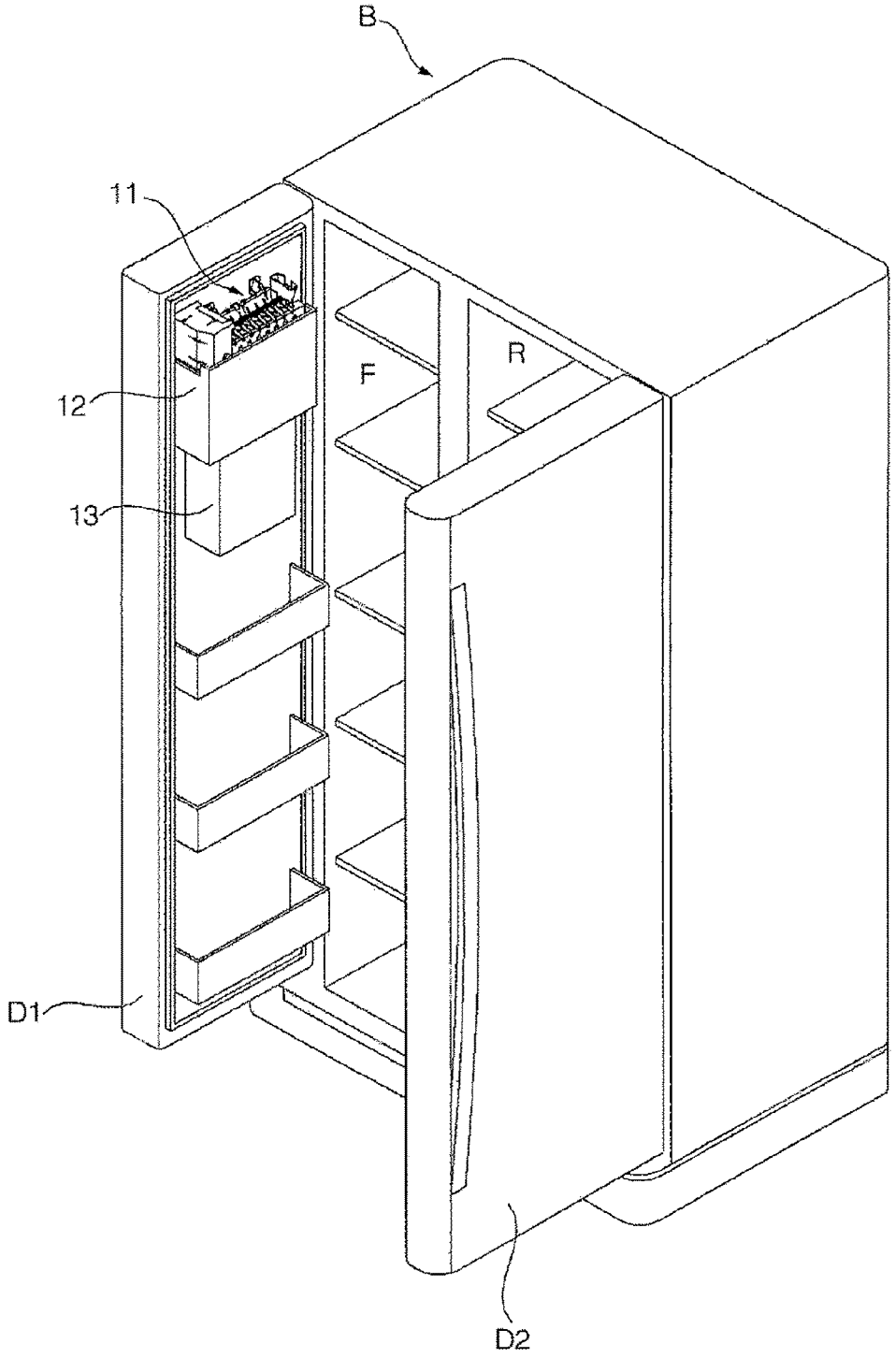

[Fig. 3]
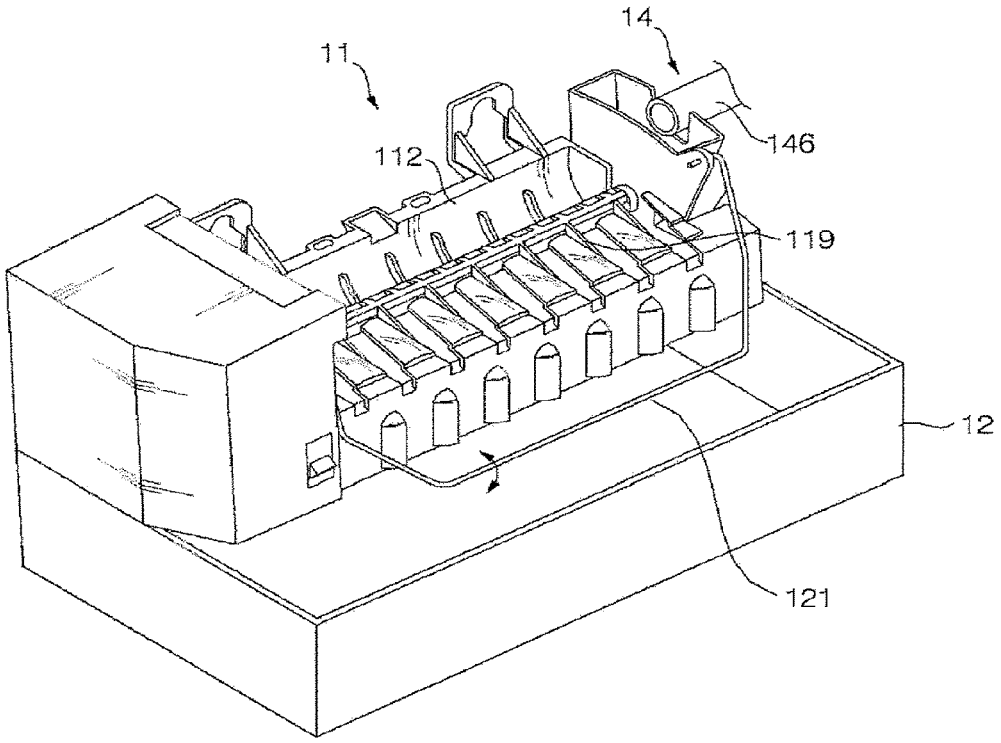
[Fig. 4]
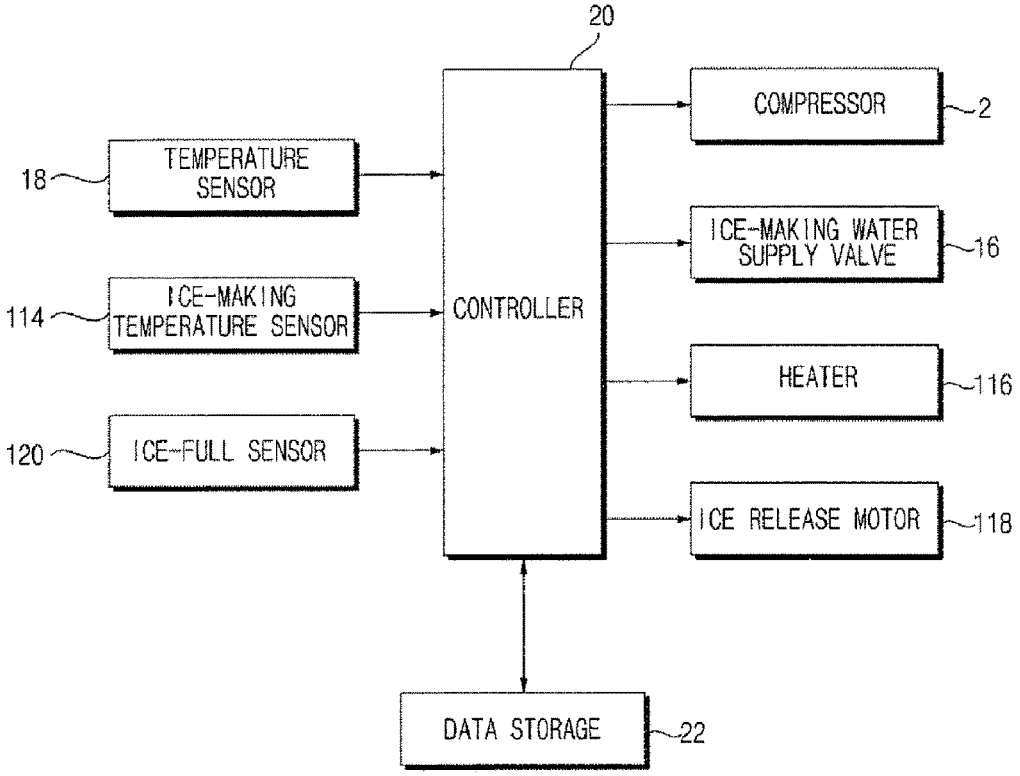

[Fig. 5]
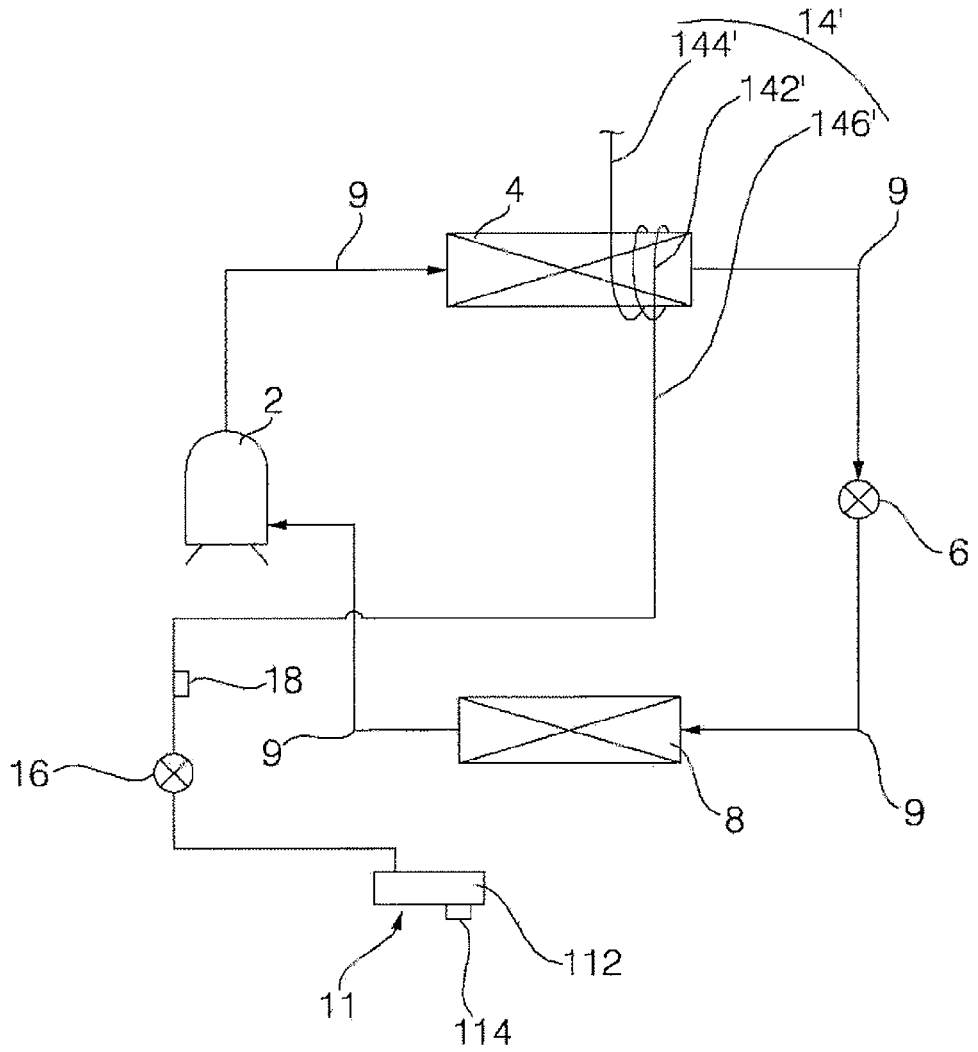

[Fig. 6]
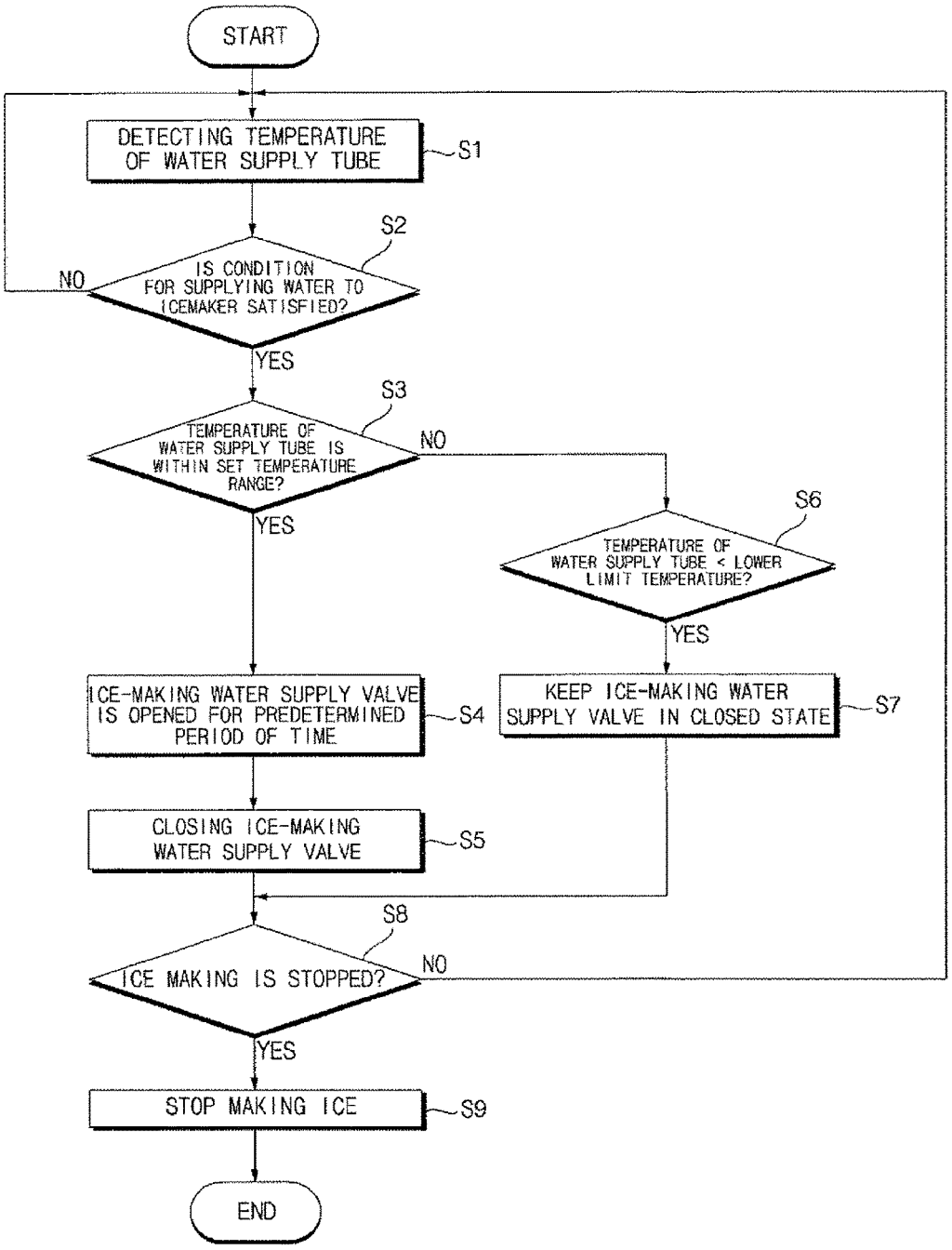

REFRIGERATOR AND METHOD OF OPERATING THE SAME

CROSS-REFERENCE TO RELATED APPLICATIONS

This application is a National Stage application under 35 U.S.C. § 371 of International Application No. PCT/KR2016/000819, filed Jan. 26, 2016, which claims the benefit of Korean Application No. 10-2015-0012232, filed on Jan. 26, 2015. The disclosures of the prior applications are incorporated by reference in their entirety.

TECHNICAL FIELD

The present invention relates to a refrigerator and a method of operating the same, and more particularly to a refrigerator and a method of operating the same.

BACKGROUND ART

Generally, a refrigerator is an apparatus that keeps, for example, food (hereinafter referred to as a "stored item") fresh using a refrigeration cycle. The refrigerator may include a freezing compartment, in which stored items are kept at a temperature below zero, and a refrigerating compartment, in which stored items are kept at a temperature above zero.

The refrigerator may be equipped with an icemaker, which produces ice using cold air.

The refrigerator may further include a water supply line for supplying water to the icemaker, and external water may be supplied to the icemaker through the water supply line. The water supply line may be provided with a water supply valve for blocking and allowing the flow of water through the water supply line, and the refrigerator may block or allow the flow of water supplied to the icemaker by closing or opening the water supply valve.

DISCLOSURE OF INVENTION

Technical Problem

Therefore, the present invention has been made in view of the above problems, and it is an object of the present invention to provide a refrigerator and a method of operating the same, which includes an icemaker capable of quickly making ice.

Solution to Problem

In accordance with an aspect of the present invention, the above and other objects can be accomplished by the provision of a refrigerator including a compressor for compressing refrigerant, a condenser in which the refrigerant, which has been compressed in the compressor, is condensed, an icemaker, a water supply tube, which supplies water to the icemaker and is in contact with at least one of the compressor and the condenser, an ice-making water supply valve installed in the water supply tube, a temperature sensor installed at the water supply tube, and a controller for controlling the ice-making water supply valve based on a temperature detected by the temperature sensor.

The water supply tube may include a waste heat recovery tube, which is in contact with the compressor, a water introduction tube for guiding water to the waste heat recovery tube, and a water discharge tube for guiding the water, which has passed through the waste heat recovery tube, to the icemaker.

The temperature sensor may be installed at the waste heat recovery tube or the water discharge tube.

The water supply tube may include a heat recovery tube, which is in contact with the condenser, a water introduction tube for guiding water to the heat recovery tube, and a water discharge tube for guiding the water, which has passed through the heat recovery tube, to the icemaker.

The temperature sensor may be installed at the heat recovery tube or the water discharge tube.

When a condition for supplying water to the icemaker is satisfied, the controller may control the ice-making water supply valve to be opened for a predetermined period of time if the temperature detected by the temperature sensor is within a set temperature range.

When a condition for supplying water to the icemaker is satisfied, the controller may control the ice-making water supply valve to be kept closed if the temperature detected by the temperature sensor is lower than a lower limit of the set temperature range.

The icemaker may include an ice-making tray which contains water supplied through the water supply tube.

The icemaker may further include an ice-making temperature sensor for measuring a temperature of the ice-making tray.

In accordance with another aspect of the present invention, there is provided a method of operating a refrigerator, including detecting a temperature of a water supply tube, which supplies water to an icemaker and is in contact with at least one of a compressor and a condenser, and controlling an ice-making water supply valve, installed in the water supply tube, based on the detected temperature of the water supply tube.

Controlling the ice-making water supply valve may be performed by, when a condition for supplying water to the icemaker is satisfied, keeping the ice-making water supply valve closed if the detected temperature of the water supply tube is lower than a lower limit of a set temperature range.

Controlling the ice-making water supply valve may be performed by, when a condition for supplying water to the icemaker is satisfied, opening the ice-making water supply valve for a predetermined period of time if the detected temperature of the water supply tube is within a set temperature range.

Advantageous Effects of Invention

As is apparent from the above description, the present invention has an advantage in that water having a temperature raised to a temperature range that is set in consideration of a Mpemba effect is supplied to the icemaker, thereby enabling rapid ice making.

Furthermore, since it is possible to raise the temperature of water to a set temperature range using the waste heat of a compressor or a condenser, the present invention has an advantage of offering higher energy efficiency than the case in which the temperature of water is raised using an electric heater.

BRIEF DESCRIPTION OF DRAWINGS

The above and other objects, features and other advantages of the present invention will be more clearly understood from the following detailed description taken in conjunction with the accompanying drawings, in which:

FIG. 1 is a view showing a refrigerant line and an ice-making water supply line of a refrigerator according to an embodiment of the present invention;

FIG. 2 is a perspective view showing the inside of the refrigerator according to the embodiment of the present invention;

FIG. 3 is a perspective view showing an icemaker and an ice bank of the refrigerator according to the embodiment of the present invention;

FIG. 4 is a control block diagram showing the refrigerator according to the embodiment of the present invention;

FIG. 5 is a view showing a refrigerant line and an ice-making water supply line of a refrigerator according to another embodiment of the present invention; and FIG. 6 is flowchart illustrating a method of operating the refrigerator according to an embodiment of the present invention.

BEST MODE FOR CARRYING OUT THE INVENTION

Hereinafter, the embodiments of the present invention will be described in detail with reference to the accompanying drawings.

FIG. 1 is a view showing a refrigerant line and an ice-making water supply line of a refrigerator according to an embodiment of the present invention. FIG. 2 is a perspective view showing the inside of the refrigerator according to the embodiment of the present invention. FIG. 3 is a perspective view showing an icemaker and an ice bank of the refrigerator according to the embodiment of the present invention. FIG. 4 is a control block diagram showing the refrigerator according to the embodiment of the present invention.

As shown in FIG. 1, the refrigerator includes a compressor 2 for compressing refrigerant, and a condenser 4 in which the refrigerant, which has been compressed in the compressor 2, is condensed. The refrigerator may further include an expansion device 6 for expanding the refrigerant, which has been condensed in the condenser 4, and an evaporator 8 for evaporating the refrigerant, which has been expanded in the expansion device 6. The compressor 2, the condenser 4, the expansion device 6 and the evaporator 8 may be sequentially connected to a refrigerant tube 9 in this order.

As shown in FIG. 1, the refrigerator may include a main body B, in which storage compartments F and R are defined, and doors D1 and D2 installed on the main body B so as to open or close the storage compartments F and R. The freezing compartment F and the refrigerating compartment R may be defined in the main body B. The doors D1 and D2 may include the freezing compartment door D1 for opening or closing the freezing compartment F and the refrigerating compartment door D2 for opening or closing the refrigerating compartment R.

The compressor 2, the condenser 4, the expansion device 6 and the evaporator 8 may be installed on the main body B, and the evaporator 8 may be connected to at least one of the freezing compartment F and the refrigerating compartment R via a cold air circulation channel.

The refrigerator includes an icemaker 11, a water supply tube 14, which supplies water to the icemaker 11 and is in partial contact with at least one of the compressor 2 and the condenser 4, and an ice-making water supply valve 16 installed in the water supply valve 14.

The icemaker 11 may be installed on the main body B so as to be positioned in the freezing compartment F, or may be disposed on the freezing compartment door D1 so as to be positioned on the rear surface of the freezing door D1. The icemaker 11 may make ice from water using the cold air in the freezing compartment F.

The refrigerator may further include an ice bank 12 in which ice made by the icemaker 11 is accommodated. The ice bank 12 may be disposed on the door D1, D3 so as to be positioned on the rear surface of the freezing compartment door D1. The refrigerator may further include a dispenser 13 through which the ice is discharged outward. The dispenser 13 may be installed to the freezing compartment door D1 or the refrigerating compartment door D2.

The icemaker 11 may make ice and deliver the ice to the ice bank 12, and the ice accommodated in the ice bank 12 may be discharged outward through the dispenser 31.

The icemaker 11 may include an ice-making tray 112, in which the water supplied through the water supply tube 14 is accommodated. The ice-making tray 112 defines an ice-making space, in which water is accommodated, and the water supplied from the water supply tube 14 into the ice-making space may be made into ice using cold air inside the freezing compartment F.

The icemaker 11 may further include an ice-making temperature sensor 114, which measures the temperature inside the icemaker 11. The ice-making temperature sensor 114 may be installed to the ice-making tray 112, and may detect the temperature of the ice-making tray 112. The ice-making temperature sensor 114 may detect the temperature and output the detected temperature to the controller 20, which will be described later. The controller 20 may determine whether or not the ice-making operation of the icemaker 11 is completed based on a temperature signal output from the ice-making temperature sensor 114.

The icemaker 11 may further include a heater 116, which melts the ice made in the ice-making tray 112 so as to allow the ice to be easily separated from the ice-making tray 112. The heater 116 may be installed to the ice-making tray 112. The heater 116 may heat the ice-making tray 112 to raise the temperature of the ice-making tray 112 when it is required to release the ice into the ice bank 12, and the ice in contact with the ice-making tray 112 may be melted, which may ensure the easy release of ice by an ice release device, which will be described later.

The icemaker 11 may further include the ice release device, which drops the ice made in the icemaker 11 into the ice bank 12.

When the ice release device is turned on, the ice release device may scoop up the ice from the icemaker 11 and drop the ice into the ice bank 112. In this case, the ice release device may include an ice release motor 118, and an ejector 119, which is rotated by the ice release motor 118 and scoops up the ice from the icemaker 11.

Alternatively, when the ice release device is turned on, the ice release device may twist the ice-making tray 112 so as to drop the ice from the ice-making tray 112 into the ice bank 12. The ice release device may include an ice release motor, which is connected to the ice-making tray 112 and rotates the ice-making tray 112, and a protrusion configured to be caught by the ice-making tray 112 so as to twist the ice-making tray 112.

The refrigerator may include an ice-full sensor 32, which is capable of detecting that the ice-bank 12 is full of ice. The ice-full sensor 120 may function to detect the height of ice accommodated in the ice bank 12, and various kinds of sensors may be used as the ice-full sensor 120 so long as they are capable of detecting the height of ice accommodated in the ice bank 12.

The ice-full sensor 120 may include a lever 121 located above the ice bank 12 so as to be pivotably rotated up and down, and a lever rotator for rotating the lever. The height of ice accommodated in the ice bank 12 may be detected by the angle of rotation of the lever rotator.

Alternatively, the ice-full sensor 120 may include an elevating member configured to be vertically moved into the ice bank 12, and an elevator for vertically moving the elevating member, and may detect the height of the ice accommodated in the ice bank 12.

Of course, the ice-full sensor 120 may be configured as an ultraviolet sensor, which is capable of detecting the height of ice from a long distance away.

The water supply tube 14 may guide the water, supplied from the outside, toward the icemaker 11 upon opening of the ice-making water supply valve 16. The water supply tube 14 may partially contact the compressor 2 such that the water, supplied from the outside, absorbs heat from the compressor 2 and is supplied to the icemaker 11. When the water supply tube 14 contacts the compressor 2, the water supply tube 14 may raise the temperature of the water to be supplied to the icemaker 11 using the heat from the compressor 2, which may assist the icemaker 11 in quickly making ice using a Mpemba effect. The "Mpemba effect" refers to the phenomenon by which hot water sometimes freezes faster than cold water under specific conditions. For example, according to the Mpemba effect, water at 35° C. may freezes faster than water at 5° C.

The water supply tube 14 may include a waste heat recovery tube 142 in contact with the compressor 2, a water introduction tube 144 for guiding water to the waste heat recovery tube 142, and a water discharge tube 146 for guiding the water, which has passed through the waste heat recovery tube 142, to the icemaker 11.

The waste heat recovery tube 142 may be disposed such that at least a portion thereof is wound around the compressor 2 at least once. The portion of the waste heat recovery tube 142 that surrounds the compressor 2 may contact the outer surface of the compressor 2, and the heat of the compressor 2 may be transferred to the water through the waste heat recovery tube 142.

One end of the water introduction tube 144 may be disposed outside the refrigerator, and the other end thereof may be connected to the waste heat recovery tube 142. The water introduction tube 144 may be integrally formed with the waste heat recovery tube 142, or may be separately prepared and then coupled to the waste heat recovery tube 142.

The water discharge tube 146 may be positioned at one end thereof so as to guide water to the icemaker 11 and may be connected at the other end thereof to the waste heat tube 142. The water discharge tube 146 may be integrally formed with the waste heat tube 142, or may be separately prepared and then coupled to the waste heat recovery tube 142.

The ice-making water supply valve 16 may block or allow the flow of water therethrough. The ice-making water supply valve 16 may be installed in the water discharge tube 146. When the ice-making water supply valve 16 is turned on, the ice-making water supply valve 16 may be opened, and water may be supplied to the icemaker 11 through the water supply tube 14. When the ice-making water supply valve 16 is turned off, the ice-making water supply valve 16 may be closed, and the supply of water through the water supply tube 14 may be blocked.

The refrigerator includes a temperature sensor 18 installed at the compressor 2, and a controller 20 for controlling the ice-making water supply valve 16 based on the temperature detected by the temperature sensor 18.

The temperature sensor 18 may be installed at the waste heat recovery tube 142 or the water discharge tube 144. The temperature sensor 18 may detect the temperature of the tube and output the temperature to the controller 20 at intervals.

The controller 20 may store the temperature of the water supply tube 14, detected by the temperature sensor 18, in a data storage 22 such as a memory. The controller may read the temperature that is recently stored in the data storage 22 and compare the temperature with a set temperature range, which will be described later, when the condition for supplying water to the icemaker 11 is satisfied.

The controller 20 may turn on or off the compressor 2 based on the load of at least one of the freezing compartment F and the refrigerating compartment R.

When the condition for supplying water to the icemaker 11 is satisfied, the controller 20 may open the ice-making water supply valve 16 for a predetermined period of time when the temperature detected by the temperature sensor 18 is within the set temperature range. When the condition for supplying water to the icemaker 11 is satisfied, the controller 20 may keep the ice-making water supply valve 16 closed when the temperature detected by the temperature sensor 18 is lower than the lower limit of the set temperature range.

The condition for supplying water to the icemaker 11 may be the condition under which the ice in the ice-making tray 112 is completely released from the ice-making tray 112 by the ice release device.

The set temperature range may be a temperature range which is previously set in consideration of the Mpemba effect. The set temperature range may be set as a temperature range in which the ice-making completion time (that is, the time taken to completely make ice after water is supplied to the icemaker 11 from the water supply tube 14) is minimized. The set temperature range may be experimentally determined so as to minimize the ice-making completion time. The set temperature range may have a lower limit temperature and an upper limit temperature. In one instance, the lower limit temperature may be set to be 33° C., and the upper limit temperature may be set to be 37° C.

The set temperature range may be differently set for different temperature zones of the freezing compartment F. At least one of the lower limit temperature and the upper limit temperature of the set temperature range may be differently set based on temperature zones. In one example, the set temperature range may be set to be a range of 33° C. to 37° C. when the temperature of the freezing compartment is −20° C., and may be set to be a range of 34° C. to 38° C. when the temperature of the freezing compartment is above −20° C. but is equal to or lower than −10° C.

The predetermined period of time may be the time taken to fill the ice-making tray 112 with water.

FIG. 5 is a view showing the refrigerant line and the ice-making water supply line of the refrigerator according to another embodiment of the present invention.

A water supply tube 14' according to this embodiment may absorb heat from the condenser 4 so as to raise the temperature of water. The water supply tube 14' includes a heat recovery tube 142', which is in contact with the condenser 4, a water introduction tube 144' for guiding water to the heat recovery tube 142' and a water discharge tube 146' for guiding the water, which has passed through the heat recovery tube 142', to the icemaker 11. Since this embodiment is identical or similar to the previous embodiment with respect to components and operation other than the water supply tube 14', the other components are designated by the same reference numerals, and the description thereof is omitted.

The condenser 4 may include a water-cooling type heat exchanger at which refrigerant exchanges heat with water. The water-cooling type heat exchanging unit includes a refrigerant channel, through which refrigerant flows, and a water channel through which water flows. The refrigerant channel and the water channel may be compartmentalized with a heat transfer member disposed therebetween. In this case, the water recovery tube 142' may define the water channel.

The condenser 4 may be constituted by an air-cooling type heat exchanger, and the heat recovery tube 142' may be attached to the surface of the condenser 4 so as to allow heat transfer therebetween.

The temperature sensor 18 may be installed on the heat recovery tube 142' or the water discharge tube 146'.

FIG. 6 is flowchart illustrating a method of operating the refrigerator according to an embodiment of the present invention.

The method of operating the refrigerator may include a step S1 of supplying water to the icemaker 11 and detecting the temperature of the water supply tube 14, which is in contact with at least one of the compressor 2 and the condenser 4.

In step S1 of detecting the temperature of the water supply tube 14, the temperature sensor 18 may detect the temperature of the water supply tube 14 and output the temperature to the controller 20.

The method of operating the refrigerator includes steps S2, S3, S4, S5, S6 and S7 of controlling the ice-making water supply valve 16, which is installed in the water supply tube 14, based on the detected temperature of the water supply tube 14.

Steps S2, S3, S4, S5, S6 and S7 of controlling the ice-making water supply valve 16 may be steps of controlling the ice-making water supply valve 16 to be opened or to be kept closed.

In steps S2, S3, S4, S5, S6 and S7 of controlling the ice-making water supply valve 16, when the condition for supplying water to the icemaker 11 is satisfied, the ice-making water supply valve 16 may be opened for the predetermined period of time when the detected temperature of the water supply tube 14 is within the set temperature range (S2, S3 and S4).

When the condition for supplying water to the icemaker 11 is satisfied, the controller 20 may compare the temperature of the water supply tube 14 with the lower limit and upper limit of the set temperature range. If the temperature of the water supply tube 14 is determined to be within the set temperature range, the ice-making water supply valve 16 may be opened for a predetermined period of time (S2, S3 and S4).

The condition for supplying water to the icemaker 11 may be the condition under which the ice in the ice-making tray 112 is completely released from the ice-making tray 112 by an ice release device. When the ice in the ice-making tray 112 is completely released from the ice-making tray 112 by the ice release device, the controller 20 may compare the temperature detected by the temperature sensor 18 with the lower limit and the upper limit of the set temperature range (S2 and S3).

If the temperature detected by the temperature sensor 18 is determined to be within the set temperature range, the current temperature of the water in the water supply tube 14 is the temperature at which ice can be rapidly released according to the Mpemba effect, and the controller 20 may open the ice-making water supply valve 16 for the predetermined period of time (S4). When the ice-making water supply valve 16 is opened, the water in the water supply tube 14 may be supplied to the icemaker 11 and may be made into ice.

When a predetermined period of time has elapsed since the ice-making water supply valve 16 was opened, the controller 20 may control the ice-making water supply valve 16 to be closed (S5).

If the detected temperature of the water supply tube is determined to be lower than the lower limit of the set temperature range, steps S2, S3, S4, S5, S6 and S7 of controlling the ice-making water supply valve 16 may keep the ice-making water supply valve 16 closed (S2, S3, S6 and S7).

When the condition for supplying water to the icemaker 11 is satisfied, the temperature of the water supply tube 14 may be compared with the lower limit of the set temperature range (S2, S3 and S6).

If the temperature detected by the temperature sensor 18 is determined to be lower than the lower limit of the set temperature range, the temperature of the water in the water supply tube 14 is determined not to reach the set temperature range, which is determined in consideration of the Mpemba effect, and the controller 20 may keep the ice-making water supply valve 16 closed (S7).

Meanwhile, the method of operating the refrigerator may include steps S8 and S9 of no longer controlling the icemaker 11 and the ice-making water supply valve 16 and stopping the ice making by the icemaker 11 when an ice-making stop command is input via an input unit (not shown) of, for example, a control panel, or when the refrigerator is powered off.

In addition, when no ice-making stop command is input and when the refrigerator is not powered off, the method of operating the refrigerator may include steps S8 and S1 of returning to the first step S1 of detecting the temperature of the water supply tube 14.

In the method of operating the refrigerator, waste heat from the compressor 2 may be transferred to the water supply tube 14, and thus the temperature detected by the temperature sensor 18 may reach the lower limit of the set temperature range. In this case, the controller 20 may no longer maintain the ice-making water supply valve 16 in the closed state, and may open the ice-making water supply valve 16 for the predetermined period of time, whereby the water, the temperature of which is raised by the waste heat, may be supplied to the icemaker 11 and may be made into ice.

The present invention is not limited to the above embodiments, and various modifications are possible, without departing from the technical scope and spirit of the invention.

MODE FOR THE INVENTION

Various embodiments have been described in the best mode for carrying out the invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A refrigerator comprising:

a compressor for compressing refrigerant;

a condenser in which the refrigerant, which has been compressed in the compressor, is condensed;

an icemaker;

a water supply tube, which supplies water to the icemaker and is in contact with at least one of the compressor and the condenser;

an ice-making water supply valve installed in the water supply tube;

a temperature sensor installed at the water supply tube; and a controller for controlling the ice-making water supply valve based on a temperature detected by the temperature sensor.

2. The refrigerator according to claim 1, wherein the water supply tube comprises:

a waste heat recovery tube in contact with the compressor;

a water introduction tube for guiding water to the waste heat recovery tube; and a water discharge tube for guiding the water, which has passed through the waste heat recovery tube, to the icemaker.

3. The refrigerator according to claim 2, wherein the temperature sensor is installed at the waste heat recovery tube or the water discharge tube.

4. The refrigerator according to claim 1, wherein the water supply tube comprises:

a heat recovery tube in contact with the condenser;

a water introduction tube for guiding water to the heat recovery tube; and a water discharge tube for guiding the water, which has passed through the heat recovery tube, to the icemaker.

5. The refrigerator according to claim 4, wherein the temperature sensor is installed at the heat recovery tube or the water discharge tube.

6. The refrigerator according to claim 1, wherein, when a condition for supplying water to the icemaker is satisfied, the controller controls the ice-making water supply valve to be opened for a predetermined period of time if the temperature detected by the temperature sensor is within a set temperature range.

7. The refrigerator according to claim 1, wherein, when a condition for supplying water to the icemaker is satisfied, the controller controls the ice-making water supply valve to be kept closed if the temperature detected by the temperature sensor is lower than a lower limit of the set temperature range.

8. The refrigerator according to claim 1, wherein the icemaker includes an ice-making tray which contains water supplied through the water supply tube.

9. The refrigerator according to claim 8, wherein the icemaker further includes an ice-making temperature sensor for measuring a temperature of the ice-making tray.

10. A method of operating a refrigerator, comprising:

detecting a temperature of a water supply tube, which supplies water to an icemaker and is in contact with at least one of a compressor and a condenser; and controlling an ice-making water supply valve, installed in the water supply tube, based on the detected temperature of the water supply tube.

11. The method according to claim 10, wherein controlling the ice-making water supply valve is performed by, when a condition for supplying water to the icemaker is satisfied, keeping the ice-making water supply valve closed if the detected temperature of the water supply tube is lower than a lower limit of a set temperature range.

12. The method according to claim 10, wherein controlling the ice-making water supply valve is performed by, when a condition for supplying water to the icemaker is satisfied, opening the ice-making water supply valve for a predetermined period of time if the detected temperature of the water supply tube is within a set temperature range.

* * * * *